US006708587B1

(12) United States Patent
Noniewicz et al.

(10) Patent No.: US 6,708,587 B1
(45) Date of Patent: Mar. 23, 2004

(54) VISE-GRIP OR EXPANDING PLIERS

(75) Inventors: Zhigniew Noniewicz, Kempenich (DE); Hans-Jurgen Schuller, Konigsfeld (DE)

(73) Assignee: Wolfcraft GmbH (DE)

( * ) Notice: Subject to any disclaimer, the term of this patent is extended or adjusted under 35 U.S.C. 154(b) by 0 days.

(21) Appl. No.: 09/743,063

(22) PCT Filed: Jan. 26, 2000

(86) PCT No.: PCT/EP00/00565

§ 371 (c)(1),
(2), (4) Date: Mar. 13, 2001

(87) PCT Pub. No.: WO00/47371

PCT Pub. Date: Aug. 17, 2000

(30) Foreign Application Priority Data

Feb. 11, 1999 (DE) ..... 199 05 594
Jul. 15, 1999 (DE) ..... 199 33 033

(51) Int. Cl.[7] ..... B25B 7/14

(52) U.S. Cl. ..... 81/322; 81/313; 81/319; 81/337; 81/392; 81/417

(58) Field of Search ..... 81/313–314, 318–325, 81/329–331, 336–340, 364–366, 385, 387, 391–392, 416–417

(56) References Cited

U.S. PATENT DOCUMENTS 1,052,982 A * 2/1913 Sturtevant et al. ..... 81/319
1,616,621 A * 2/1927 Hooks
1,978,543 A 10/1934 Madeira
2,750,826 A * 6/1956 Lisbon ..... 81/337
3,013,456 A 12/1961 Ericson
3,261,244 A * 7/1966 Smoyak et al. ..... 81/417
3,262,342 A * 7/1966 Filia ..... 81/313
3,277,751 A * 10/1966 Filia ..... 81/313
4,821,610 A 4/1989 Redman et al.
6,347,565 B2 * 2/2002 Steinweg ..... 81/319

FOREIGN PATENT DOCUMENTS

FR 1347377 11/1963
WO WO 98 14308 4/1998

* cited by examiner

*Primary Examiner*—D. S. Meislin
(74) *Attorney, Agent, or Firm*—Patton Boggs LLP

(57) ABSTRACT

Clamping or expanding pliers having a first plier arm pivotally connected to a second plier arm, and a toothed structure attached to the first plier arm. A catch member is movably connected to the second plier arm. A single bias spring biases the plier arm apart and biases the catch member to a resting position engaged with the toothed structure. Either with or without the single bias spring the catch member may include an intermediate release position allowing a separating movement of the first and second plier arms without disengaging the catch member from the toothed structure. The first and second plier arms may include a resiliently deformable plastic, with the catch member arranged so that the force required to move it to its release position is lower than the clamping force.

18 Claims, 11 Drawing Sheets

Figure 1:
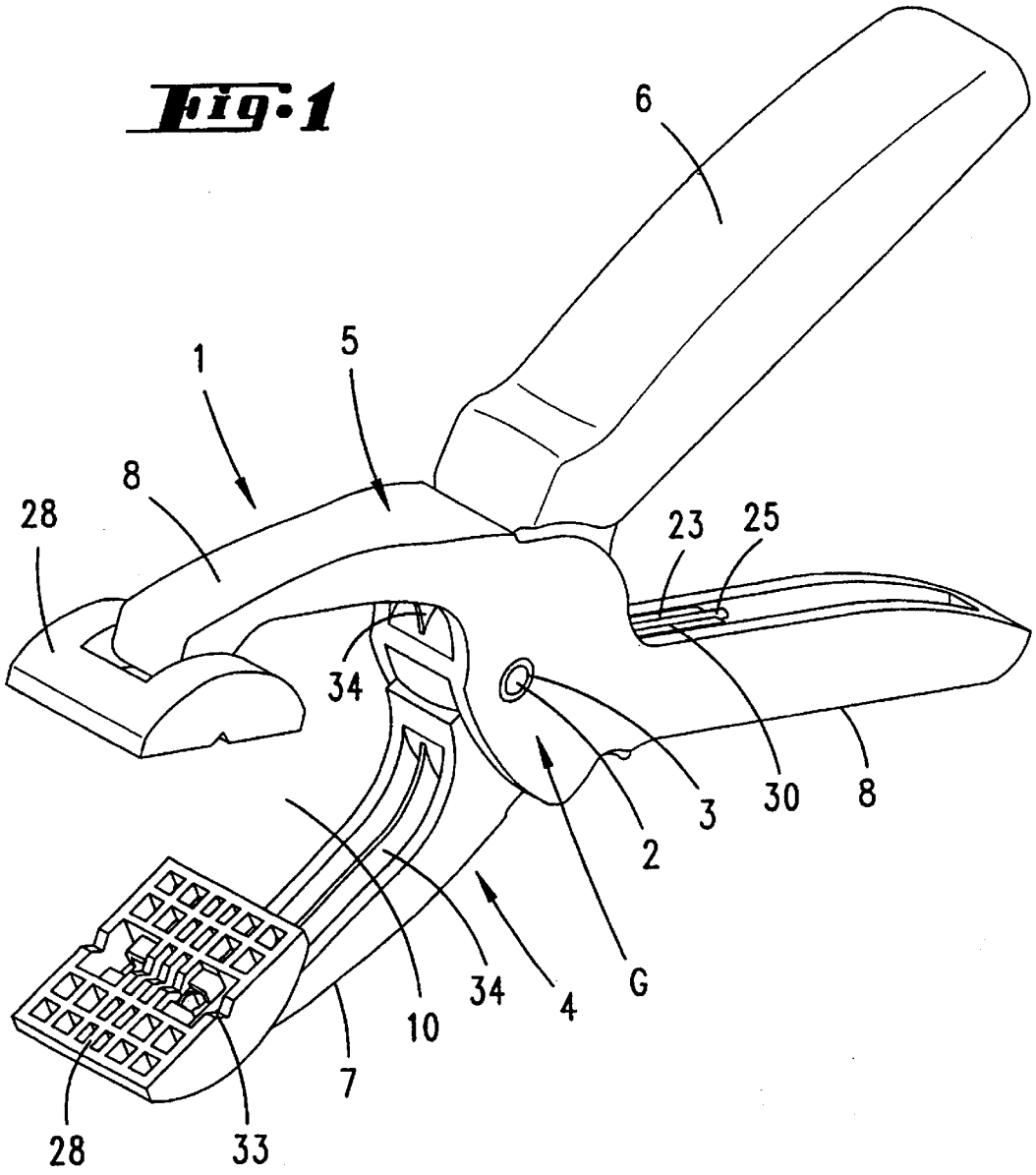

6
1
5
8
28
23
25
34
3
30
8
2
G
4
34
10
7
28
33

31
32
III
III
28
28
31
32
9
7
IV
IV
2
3
G
5
4
11
13
12
18
17
19

6
8
32
31
7
28
31
4
32

34
4
28
7

1
34
34
G
2
7
9
4
5
x
11
26
12
R
16
39
14
27
41
13
40
37'
38
F
37''
37
43
42
36
19
17
25
x
35
21
6
8

VISE-GRIP OR EXPANDING PLIERS

The invention relates to clamping or expanding pliers having two pliers arms which are connected to one another in the manner of a scissors articulation and form, at one end, handle sections and, at the other end, clamping sections which can be moved toward one another when the handles are actuated, it being possible for the two pliers arms to be latched in clamping positions with the clamping sections in a diversity of spaced apart positions.

From the Gödde catalog 1989, page 531, there is known clamping pliers for installation or assembly purposes, as also find use in the field of surgery. The clamping force is based on the restorable deformability of the pliers legs. The blades are thus of relatively narrow configuration, as are likewise the relatively long pliers jaws. In practice, they are similar to tweezers arms. The respective clamping position can be fixed by a releasable locking clamp. Corresponding tooth-like latching protrusions are located between the blades. The release operation requires the pliers arms to be twisted. This may result in the pliers jaws being offset in relation to one another.

Also known are stamped formations on cable cutters and pruning shears (U.S. Pat. No. 1,454,917, U.S. Pat. No. 4,062,218, GB patent specification 1 056 176) by way of which a toothed segment and a disengageable catch are disposed such that the pliers arms remain free from twisting. These solutions, however, require high-outlay gear mechanisms.

It is an object of the invention for clamping pliers of the generic type to be kept free of twisting forces in the knuckle joint, but nevertheless to be configured more straightforwardly in structural terms.

This object is achieved first and foremost, in the case of clamping pliers having the features of claim 1, by an arcuate toothed strip which is associated with one pliers arm and in the toothing formation of which there engages a catch which is associated with the handle section of the other pliers arm. The arcuate toothed strip may be integrated, which reduces the number of parts. The catch is associated straightforwardly with the other pliers arm. This can take place in the spatial vicinity of the knuckle joint, so that the release can also be controlled very well in terms of ergonomics. Should the clamping pliers consist of plastics material, then, for the purposes of maximizing the wear strength, the arcuate toothed strip may consist of a relatively harder plastics material than the pliers arms themselves. The arcuate toothed strip is in advantageous manner positioned in a recess of a pliers arm. In structural terms, this is such that the arcuate toothed strip is pinned to the pliers arm by means of the scissors-articulation pin and is supported thereon. It is further proposed for the clamping sections of the pliers arms to carry tiltable clamping jaws at the ends. This makes it possible, in each expanded position, for a plate-like object to be gripped in a plane-parallel manner on both sides. A further contribution of the invention is that the one pliers arm provides an opening through which the other pliers arm is inserted, this achieving the so-called inserted type of articulation for the tool. This solution is further characterized in that the inwardly-located, that is to say through-engaging pliers arm, carries the arcuate toothed strip. The solution proves favorable in terms of actuation in that the catch forms an actuating section which projects into the handle section. The actuating section is in advantageous manner located in a window of the handle section. The arrangement by which the handle section has a U-shaped cross-section, in the cavity of which the catch is rotatably located, proves favorable in structural terms and has a material-saving effect. The handle section itself has a bearing pin which passes through the cavity and is intended for the catch. It is advantageous then that the pliers arms are mounted resiliently in the expanding direction of the clamping jaws. With release of the catch, the clamping pliers thus always spring into their open position. Furthermore, a measure of even independent importance consists in the clamping force of the pliers being greater than the force which is necessary for release of the catch. This results in immediate release and opening of the clamping pliers without the catch-equipped pliers arm having to be gripped for the purpose. It is further provided for the catch to be acted upon by one arm of the expanding spring. The expanding spring thus has a double function; it functions as catch spring and as restoring spring for the clamping pliers. The corresponding accessibility in the direction of the catch is achieved by one arm of the expanding spring penetrating through a slot of the arcuate toothed strip. A further feature consists in the expanding spring being a rotary leg spring, the coil of which is secured by the scissors-articulation pin. Finally, it is also proposed for the ends of the clamping sections to provide bearing eyelets into which bearing pins of a bearing pocket of the clamping jaw project. The pockets are accessible so that such clamping jaws can be exchanged by means of an auxiliary tool, for example if specific gripping profiles are necessary. All that is required is for the clamping jaws to be exchanged. Finally, the situation where the clamping force is maintained by an elastic deformation of the clamping sections is also achieved. Powerful clamping, free from twisting, is present in the pivoting plane of the pliers arms.

An advantageous development of the clamping or expanding pliers according to the invention then consists in the catch and the actuating section being formed in two parts. This allows an intermediate function to be introduced. This is realized in that the spacing between the tooth-engagement point of the catch and toothing formation and the bearing pin for the rotatable mounting of the actuating section is shortened by a first actuation of the actuating section such that the two clamping sections are disengaged from the clamping position into a release position, the tooth engagement remaining maintained, said tooth engagement being released upon a second actuation of the actuating section. The second actuation thus no longer takes place counter to the clamping force of the tool. The first actuation requires a considerably reduced release force; the unblocking operation occurs in a "more gentle" manner. It is provided here that, upon the first actuation, catch and actuating section are pivoted toward one another and are displaced. The displacement is made possible as a result of a longitudinal slot of the catch, the bearing pin engaging through said longitudinal slot. The further means are characterized here by a disengagement pin which is associated with the actuating section, engages in an angled slot of the catch and, in the position associated with the clamping position, engages in a first slot section, which runs substantially transversely to the connecting line between tooth-engagement point and bearing pin, and, in the position associated with the release position, passes into a second slot section, which runs substantially parallel to the connecting line. The toggle-joint-like control system achieved in this way operates in a positively controlled manner: first the disengagement, then parallel displacement of the disengagement pin in the last-mentioned, that is to say second, slot section. In this case, the second slot section runs in the same direction as the longitudinal slot. Catch and actuating section are acted upon by the same arm of the expanding spring. This acts in engagement-securing manner on the ratchet mechanism.

Figures 2, 3, 4:
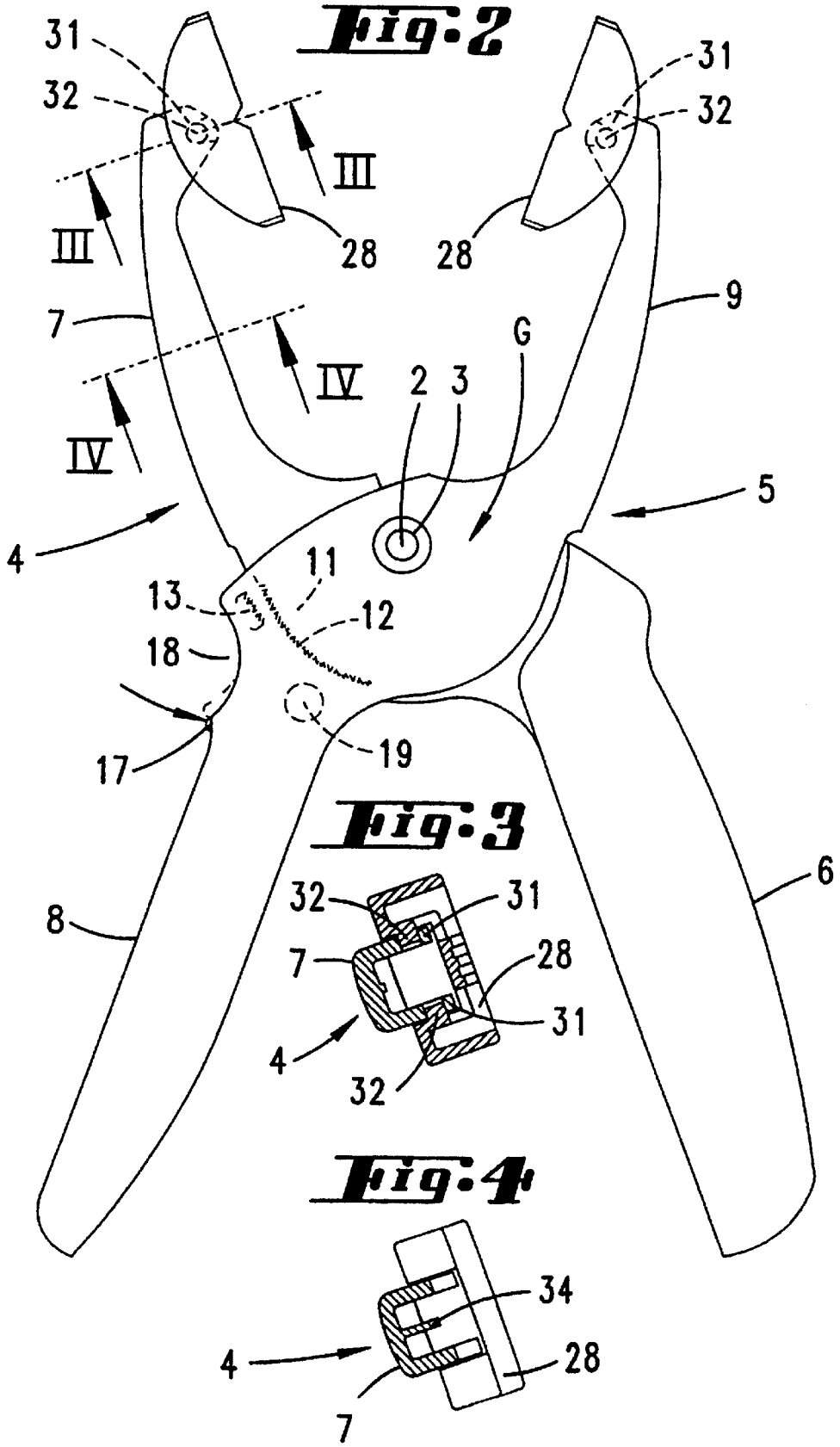
Figure 6:
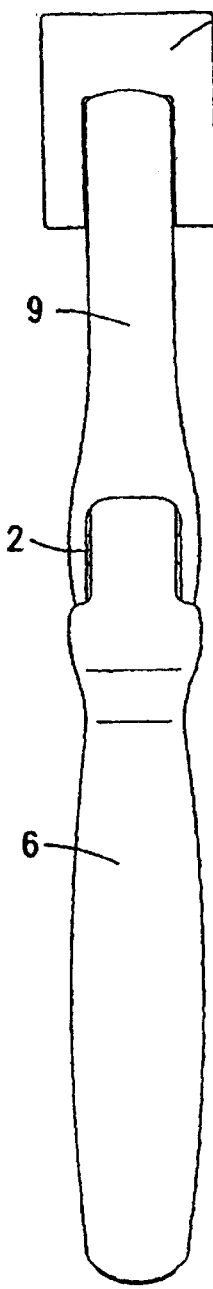
Figure 5:
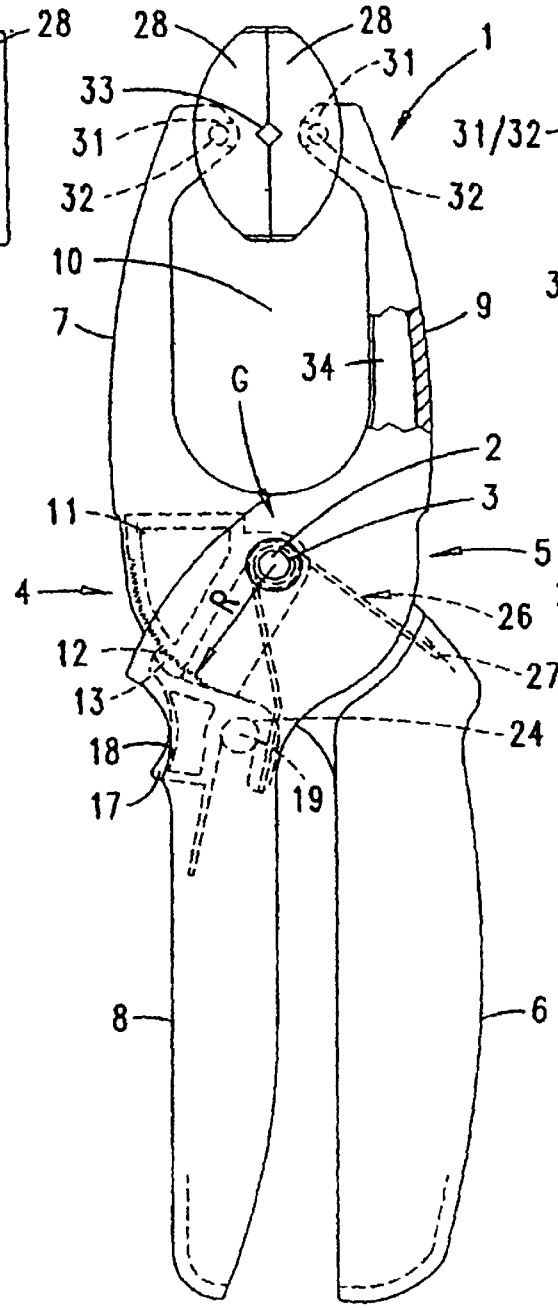
Figure 7:
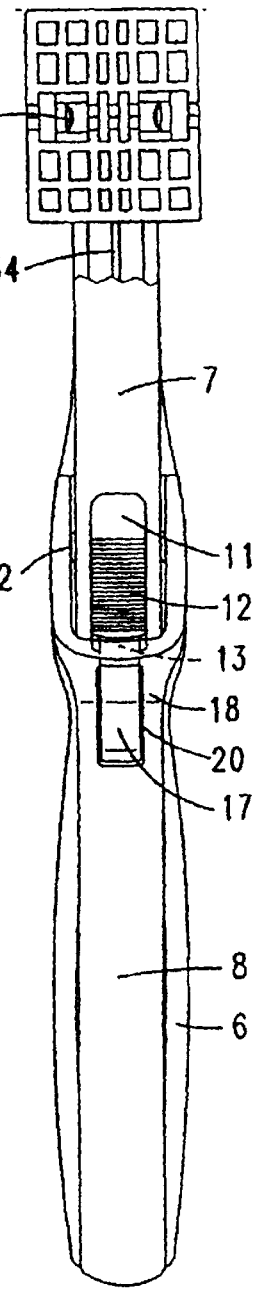
Figure 8:
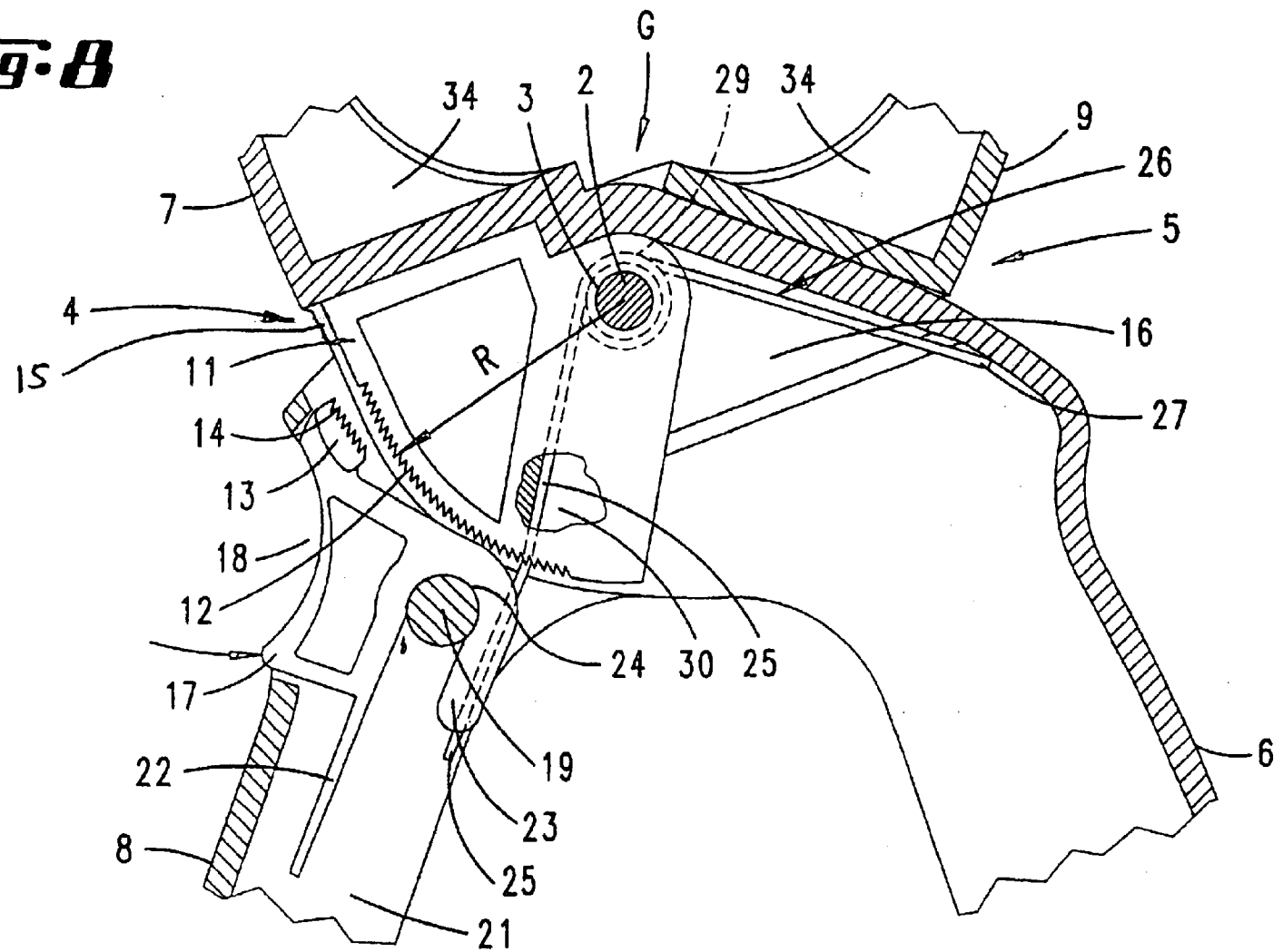
Figure 10:
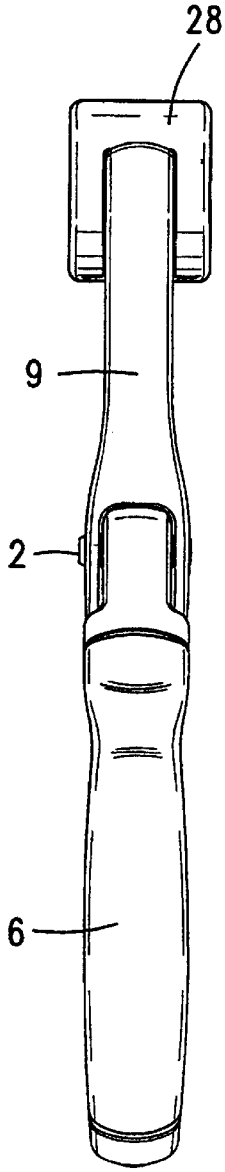
Figure 9:
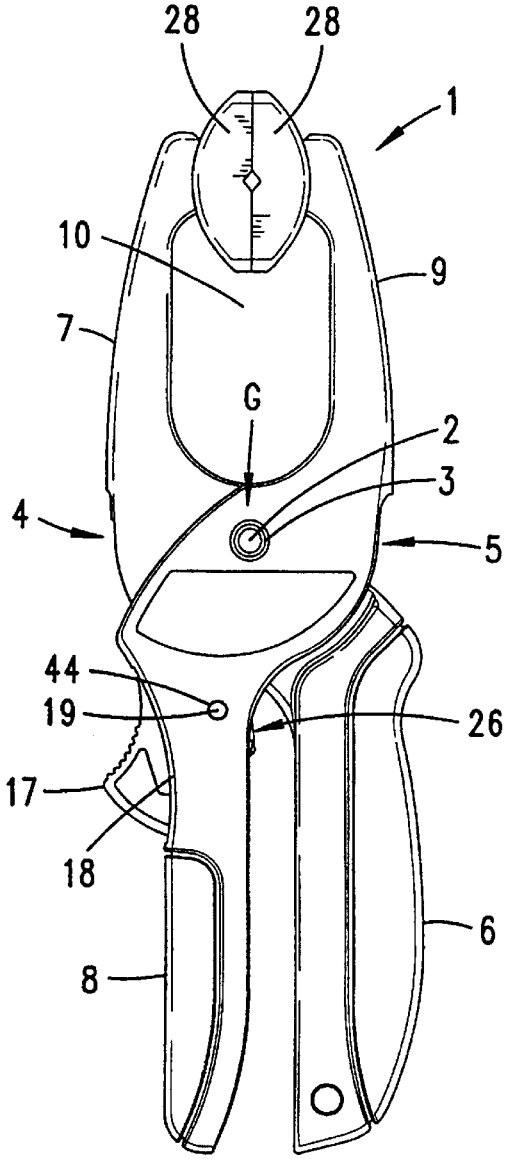
Figure 11:
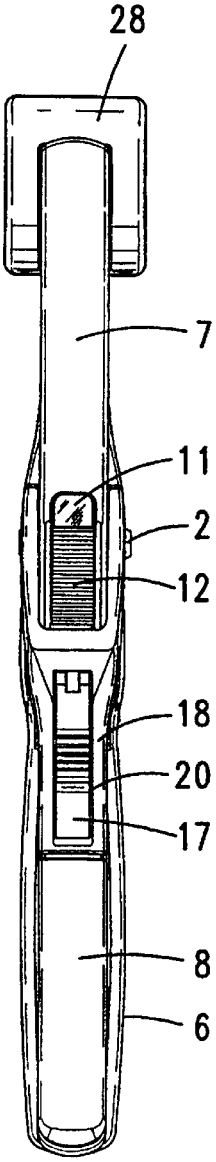
Figure 12:
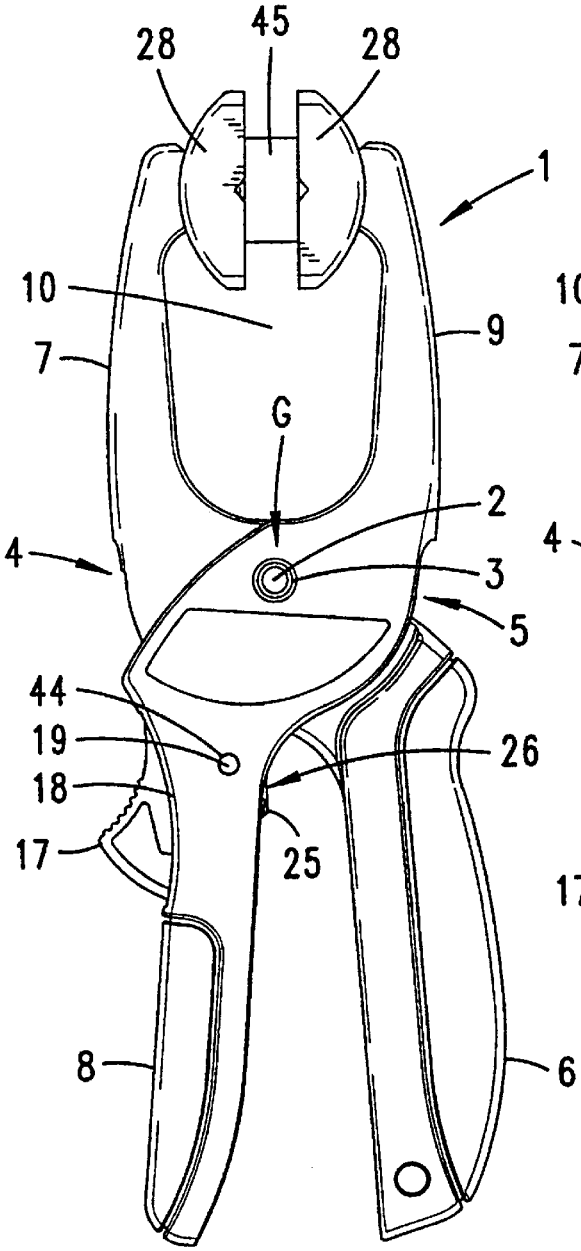
Figure 13:
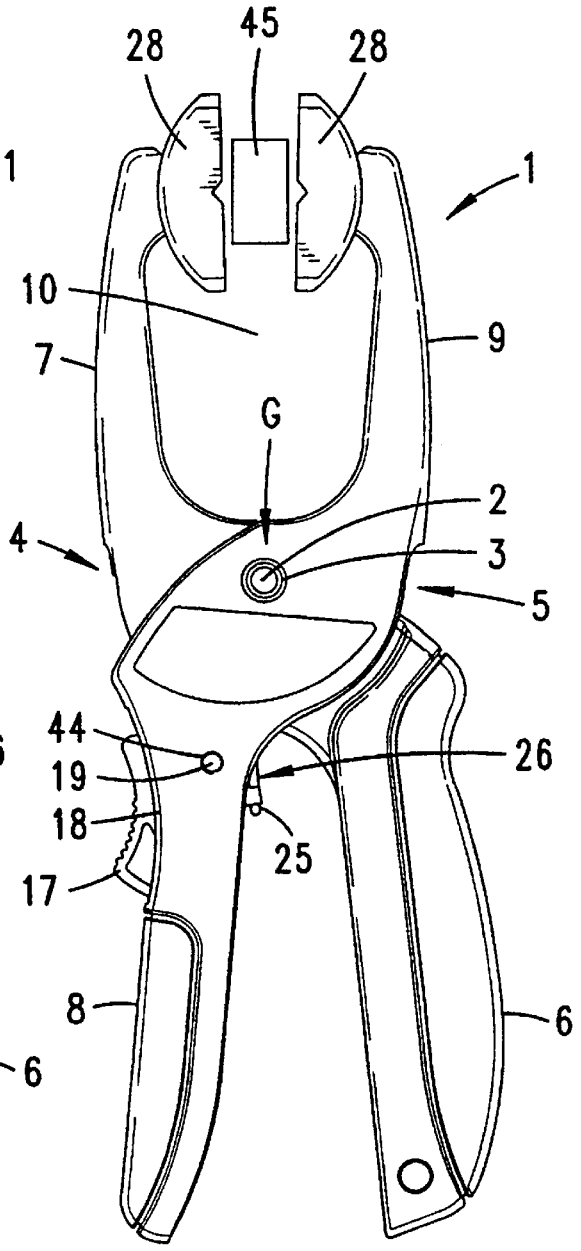
Figure 14:
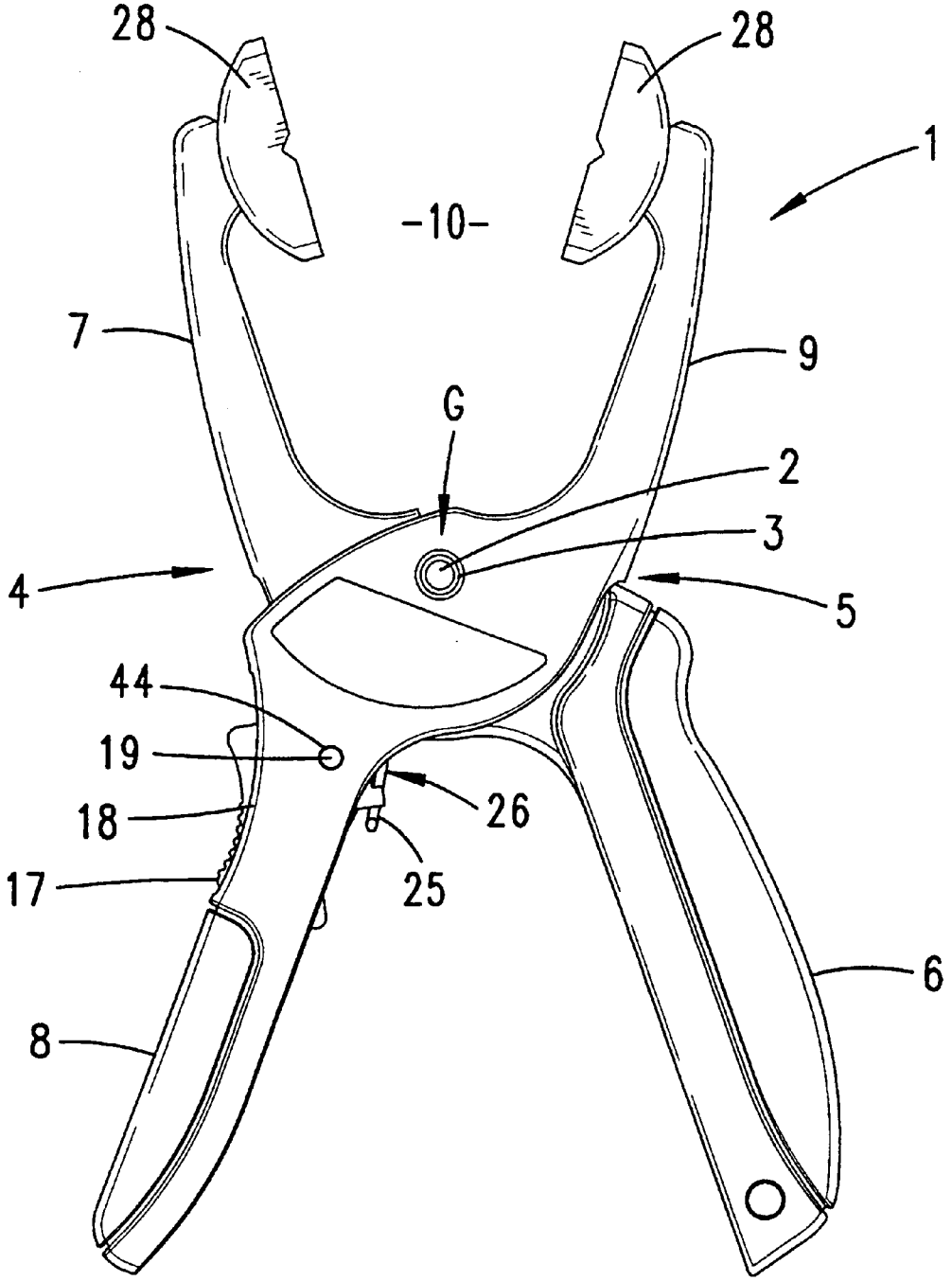
Figure 15:
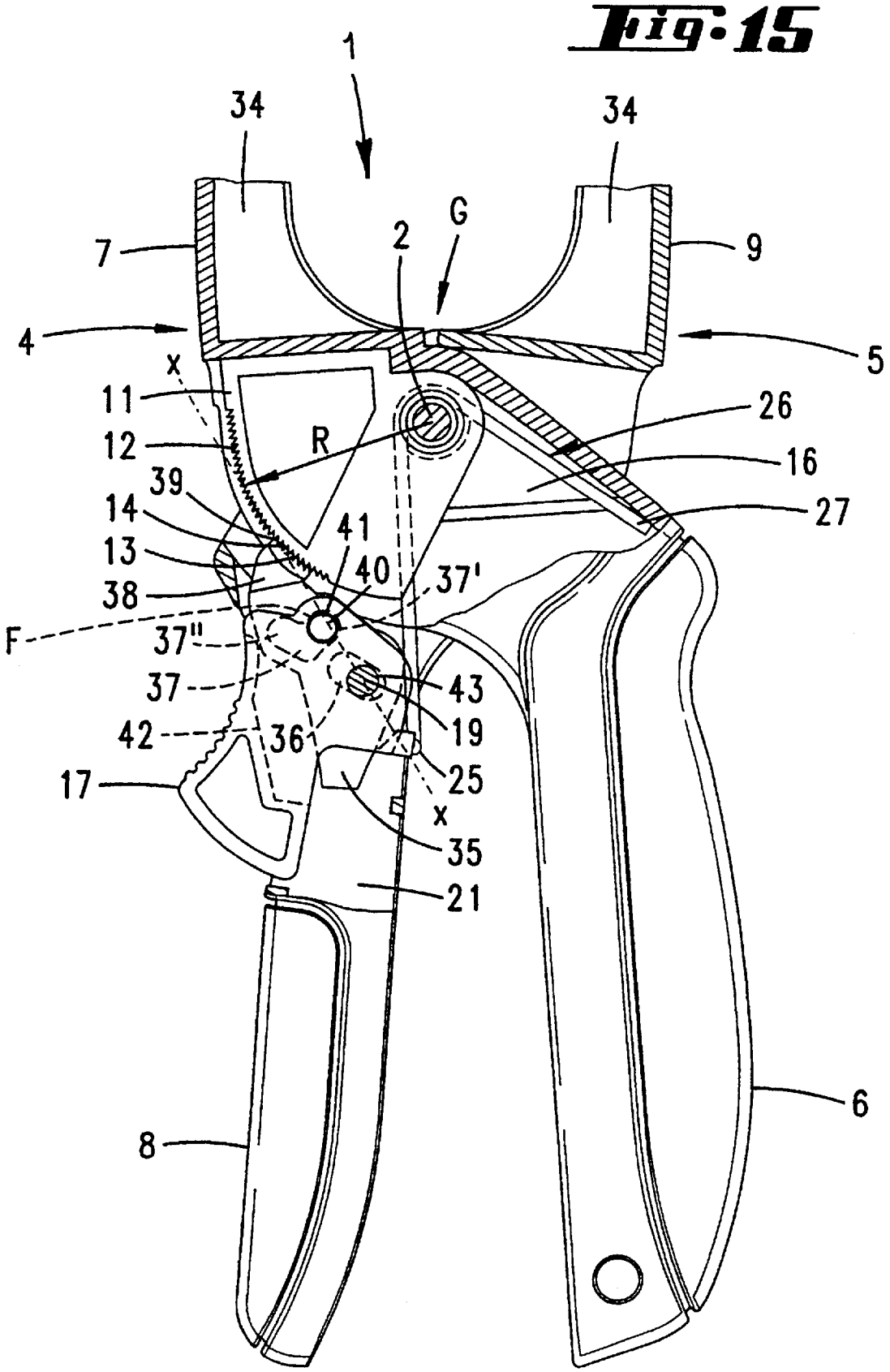
Figure 16:
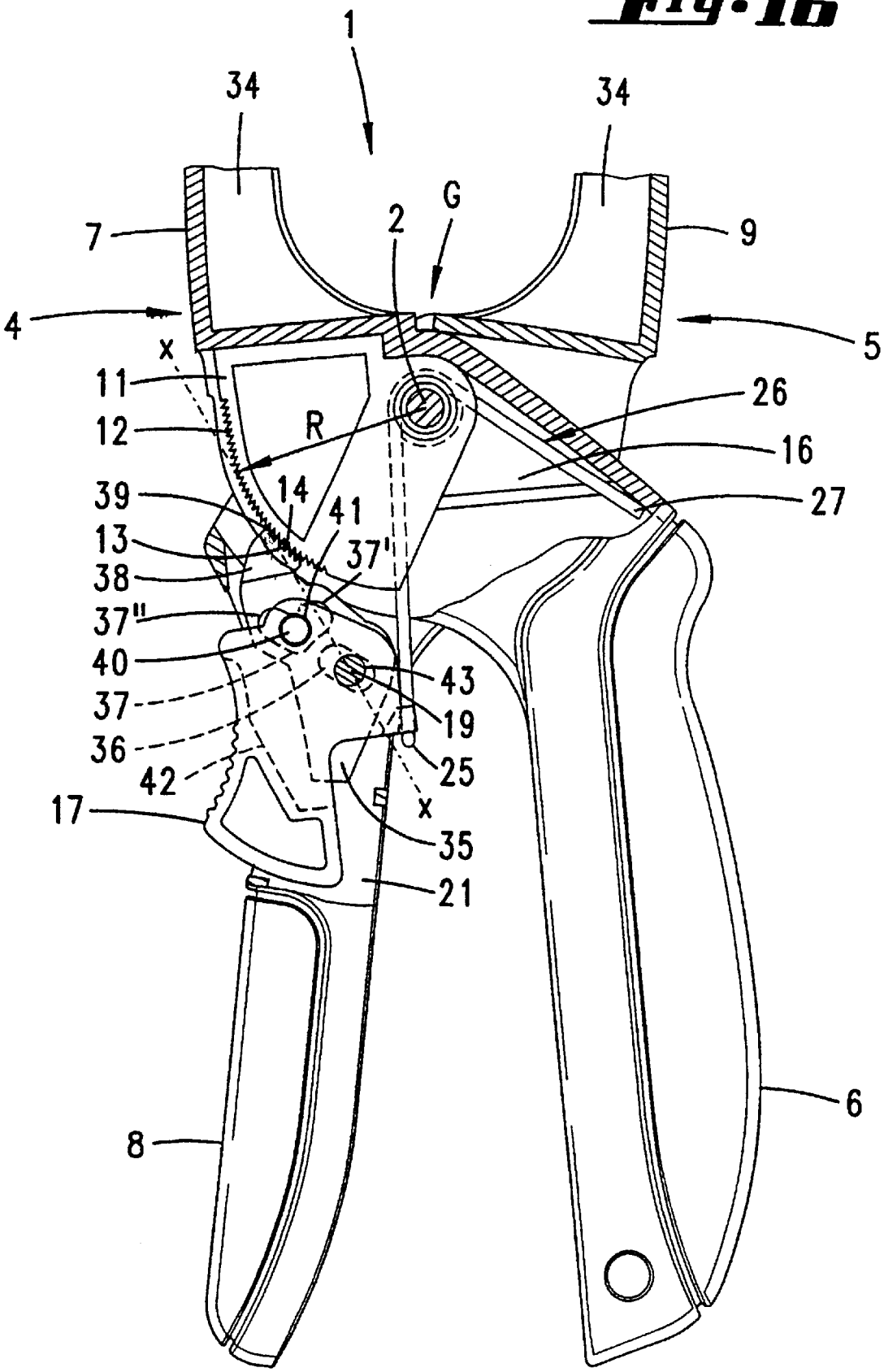
Figure 17:
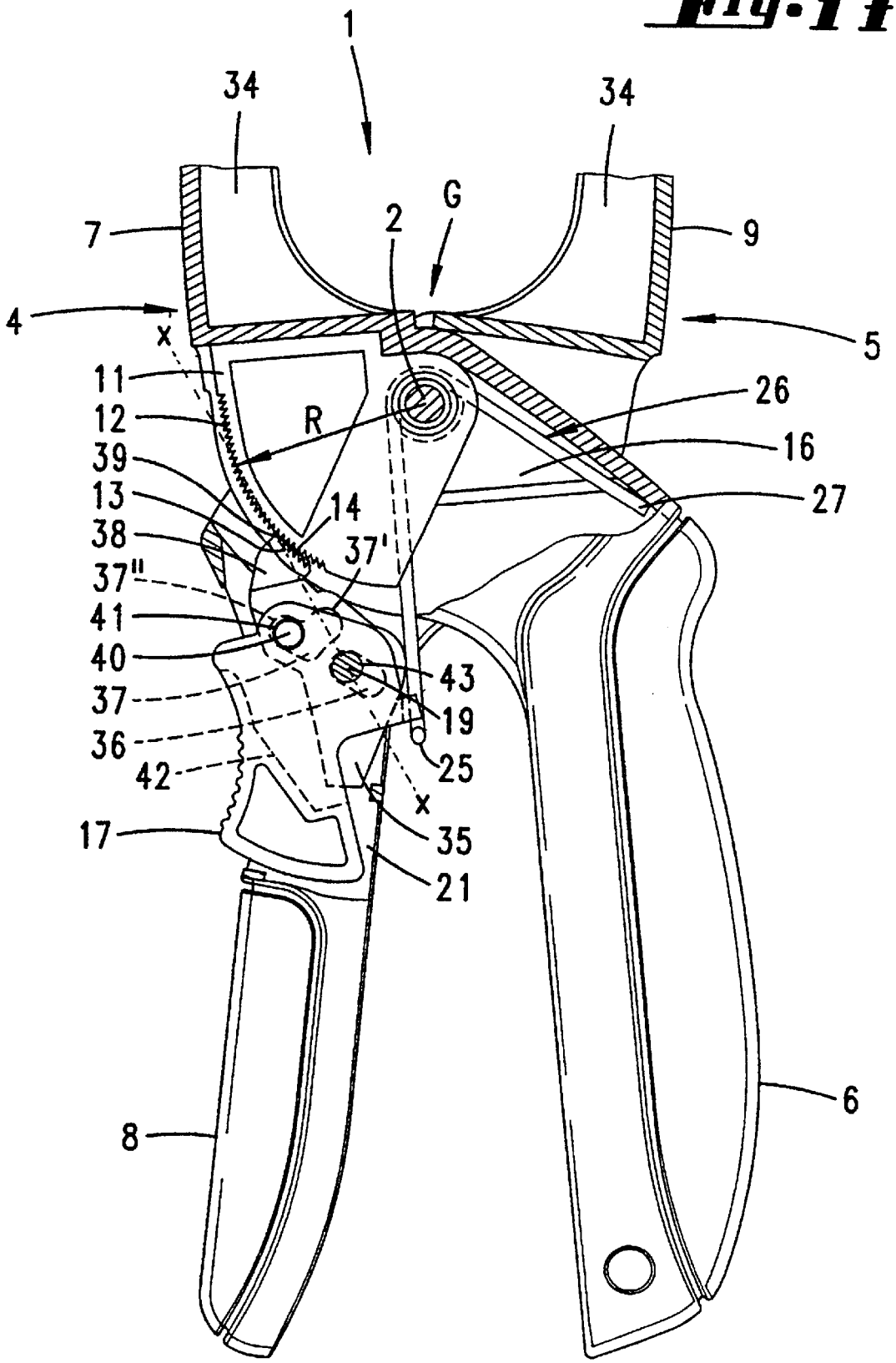
Figure 18:
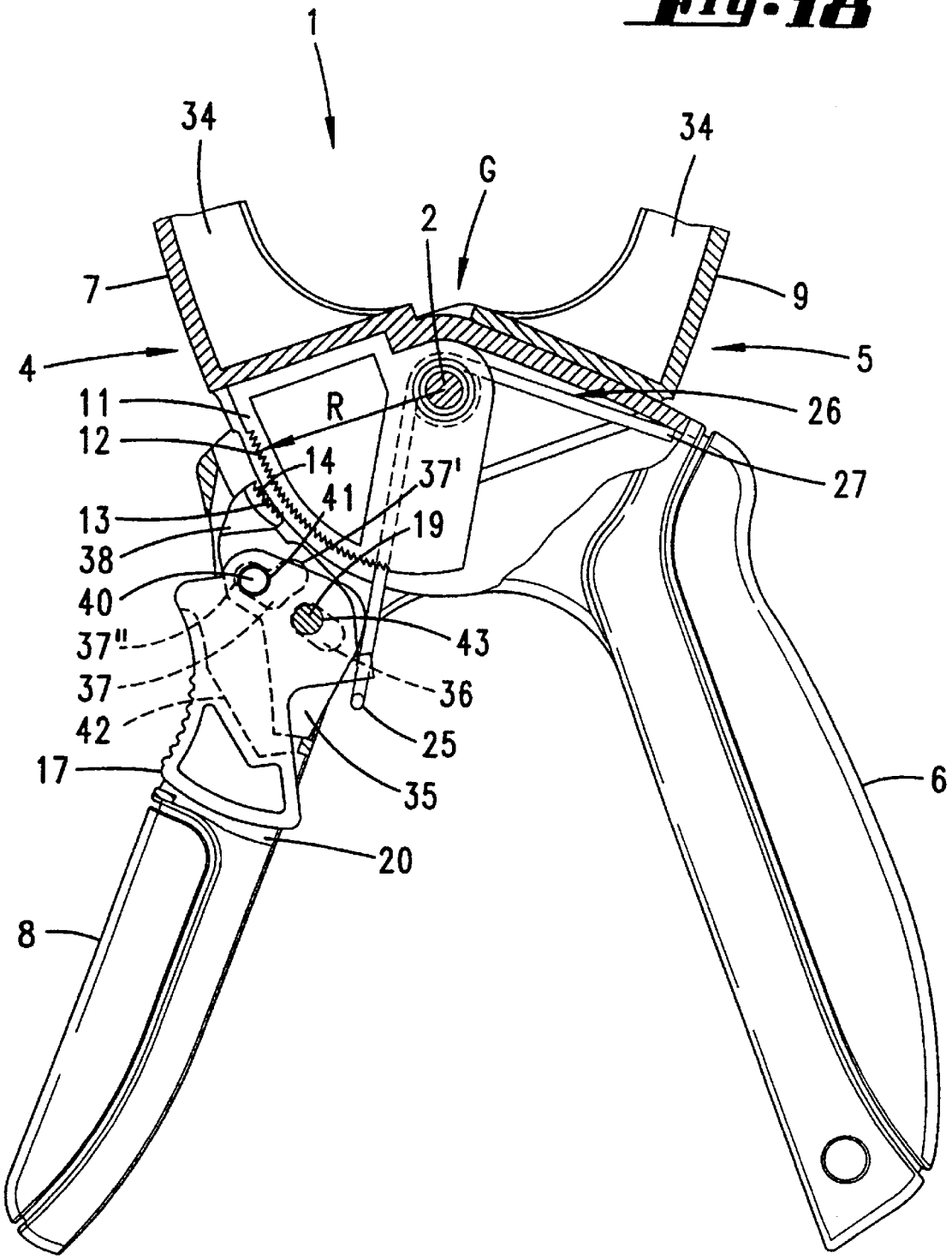

The subject-matter of the invention is explained in more detail hereinbelow with reference to two exemplary embodiments illustrated in the drawings, in which:

FIG. 1 shows the clamping pliers, with the pliers mouth open, in perspective illustration, according to the first exemplary embodiment, FIG. 2 shows this position of the clamping pliers in side view, FIG. 3 shows the section along line III—III in FIG. 2, FIG. 4 shows the section along line IV—IV in FIG. 2, FIG. 5 shows the clamping pliers in side view, but with the mouth closed, FIG. 6 shows a side view in the direction of the right-hand side of FIG. 5, FIG. 7 shows a partially cut-away side view in the direction of the left-hand side of FIG. 5, FIG. 8 shows an illustration corresponding to FIG. 2, but with knuckle-joint region and the catch region cut away, FIG. 9 shows the clamping pliers in side view, with the mouth closed, according to the second exemplary embodiment, FIG. 10 shows a side view in the direction of the right-hand side of FIG. 9, FIG. 11 shows a side view in the direction of the left-hand side of FIG. 9, FIG. 12 shows the clamping pliers gripping an object with clamping action, to be precise in side view, FIG. 13 shows the clamping pliers in a release position, FIG. 14 shows the clamping pliers in a spreading/open position, FIG. 15 shows the cut-away knuckle-joint region of the clamping pliers in the position according to FIG. 12, FIG. 16 shows the cut-away knuckle-joint region of the clamping pliers in a preliminary position which initiates the release position, FIG. 17 shows the cut-away knuckle-joint region in a position according to FIG. 13, and FIG. 18 shows the cut-away knuckle-joint region of the clamping pliers in a position according to FIG. 14.

The clamping pliers 1 illustrated is provided with a scissors articulation, but with formation of a so-called through articulation.

A scissors-articulation pin 2 also helps to form the articulation. Said pin passes through congruently located eyelets 3 in the crossover region of two pliers arms 4, 5. The pliers arm designated 4 is the inner, that is to say through-engagement, pliers arm.

The pliers arms 4, 5 consist of plastics material. They are produced in a material-saving cross-sectional form, that is to say they are preferably hollowed to be open on the mouth and handle inner sides.

The pliers arm 4 provides a handle section 6, serving for handle actuation, and has a clamping section 7, which effects the gripping of an object. In the same way, the pliers arm 5, through which the pliers arm 4 engages, has a corresponding handle section 8 and a clamping section 9. In the region of the knuckle joint G of the pliers arms 4, 5, which are connected to one another in the manner of a scissors articulation, a change in the direction of the sections 6–9 takes place, such that the pliers arms 4, 5 form, in practice, a Z-shaped outline. This results in a considerable widening between the changing-over parts of the pliers arms 4, 5.

The pliers arms 4, 5 can be latched in a clamping position. This relates both to the maximum closure position of the pliers mouth 10 of the clamping pliers 1 and also to intermediate positions up to the maximum stop-defined expanded position of the mouth-side clamping sections 7, 9. For latching in this respect, there serves an arcuate toothed strip 11. The toothing formation 12 of the latter is sawtooth-like. The arc has a radius R, the radius point of which forms the geometrical axis of the scissors-articulation pin 2.

The arcuate toothed strip 11 is associated with one pliers arm 4. It may be formed integrally therewith. It is however, preferably provided that the arcuate toothed strip 11 consists of a harder plastics material than the pliers arms 4, 5. In such a case, preference is given to multi-part construction.

A catch 13 interacts with the toothing formation 12. The catch is secured in the region of the handle section 8 of the pliers arm 5, through which the pliers arm 4 engages, but is accommodated such that it is easily accessible for actuation. The catch 13 has the corresponding mating toothing formation 14. Both the steep flank of the toothing formation 12 and also that of the mating toothing formation 14 is directed toward the radius point of the scissors-articulation pin 2. The respective rear side of the teeth presents a sloping configuration in a manner which can be seen from the illustration and is typical of sawteeth.

As can also be gathered from the drawing, the arcuate toothed strip 11 is located in a recess 15 of the through-engaging pliers arm 4, said recess being in the vicinity of the knuckle joint. The segment-like strip has a contour such that securing of said strip can be effected by the scissors-articulation pin 2, which is present in any case and thus pins the arcuate toothed strip 11 to the pliers arm 4. For this purpose, the arcuate toothed strip 11 has an eyelet located congruently with the eyelet 3. Furthermore, the recess is of such a contour that the segment-like arcuate toothed strip 11 is also supported on both sides of the rotary plane of the scissors articulation. It is very much enclosed. The whole arrangement is also bordered, on the broad sides, by wall sections of the through-engaging pliers arm 4 and also by those of the pliers arm 5, the opening of which serving for the pliers arm 4 to be inserted through being designated 16.

As can be gathered from FIG. 2, the catch 13 is placed at the knuckle-joint end of the handle section 8 such that an actuating section 17 projects laterally to be accessible from the outside. The actuating section is like a pushbutton. It is located in the region of a depression 18. The latter is located on the outside of the handle section 8 and functions as the target location to be found by feel for actuating action. The entire mechanism is within the grasp of the hand and so can be easily reached.

The catch 13, including the actuating section 17, forms a double lever which is mounted such that it can be pivoted about a pin 19 in the interior of the hollow handle section 8. The pin 19 is located on the handle inner side behind a window 20 of said handle section 8. The window is located in the U-web of the cross-sectionally U-shaped handle section 8, which leaves a hollow space 21. The catch 13 has its actuation end stop on a lower window section. The tilting angle of the catch 13, which is mounted in the manner of a rocker, is coordinated with the tooth-disengagement depth.

As can be seen, the catch 13 is, as it were, double-tailed. The two tails 22 and 23 are oriented in the direction of the handle end and leave a bearing recess 24 between them. This recess engages over more than half of the outer wall of the pin 19, which is a cylindrical body, the recess forming at the same time a bearing eyelet. This establishes a securing action. Further securing means may be dispensed with.

The tail 23, which is closer to the knuckle joint G, also has an additional function. This is because this tail 23 of the catch 13 is subjected to loading by an arm 25 of an expanding spring 26. The loading takes place in the direction of the toothing formation 12, with the effect of producing the ratchet-action engagement of the catch 13. The other arm 27 of the expanding spring 26, which is realized as a rotary leg spring, subjects the through-engaging pliers arm 4, and to be more precise that end region of the handle section 6 which is in the vicinity of the knuckle joint, to loading.

The expanding spring 26 has a prestressing and thus acts on the clamping sections 7, 9 of the clamping pliers 1 such that the pliers arms 4, 5 are subjected to loading in the expanding direction of the clamping jaws 28.

The securing of the expanding spring 26 takes place by utilizing the hollow of the coil 29 of the rotary leg spring. The scissors-articulation pin 2 of the knuckle joint G passes through said hollow.

Since, as far as the expanding spring 26 is concerned, there is a space requirement in relation to the arcuate toothed strip 11, the arcuate toothed strip 11 is provided with a slot in order to accommodate the coil 29 and the arm 25, which runs in the direction of the catch 13. The slot of the arcuate strip 11 carries the reference sign 30. Also, as far as the tail 23 is concerned, a slot which follows in the corresponding direction is realized in order to secure the position of the arm 25.

The clamping jaws 28 are associated with the clamping sections 7, 9 in a pivotably-movable manner. The corresponding geometrical axes extend parallel in space to the scissors-articulation pin 2. It can be gathered that the ends of the clamping sections 7, 9 provide bearing eyelets 31. Bearing pins 32 are snapped into said bearing eyelets. Corresponding locating slots are positioned in front of the eyelets. Bearing pins 32 of the clamping jaws 28 can easily be secured via said locating slots. The bearing pockets are formed such that access remains for the application of a release tool, so that the clamping jaws 28 can be exchanged.

The clamping pliers 1 function as follows: taking as departure point the stop-limited basic expanded position of the pliers arms 4, 5 which is illustrated in FIG. 2, it is possible for the mouth 10 of said pliers arms to be reduced with gripping of an object. This takes place by the handle sections 6 and 8 being pressed toward one another, in the direction of the handle inner sides, counter to the action of the expanding spring 26. The flat sides of the clamping jaws 28, said flat sides being directed toward one another, can move, pivoting about the bearing pins 32, into abutment flush against a, for example, plate-like object. The clamping pressure is then exerted. The clamping pliers 1 then hold themselves firmly against the object. The clamping force is maintained by an elastic deformation of the clamping sections 7, 9.

As can be gathered from FIG. 7, it is also possible for the clamping surfaces of the clamping jaws 28 to be profiled. There is illustrated a symmetrical square cross-sectional profile 33 in the form of partial V-channels which are located transversely to the pivoting plane of the pliers arms 4, 5. In order, nevertheless, to ensure the necessary resilience of the pliers arms 4, 5, the U-profile cross-section of the same is additionally reinforced by a longitudinal web 34 extending from the U-base.

If it is intended to release the clamping action, all that is required is for the handle section designated by 6 to be gripped, i.e. to be positioned in the hollow of the hand and merely for the catch 13 to be pressed using one finger of said hand. The catch is thus unlatched. The clamping pliers 1 move back, by spring action, into their basic expanded position according to FIG. 2. In this case, the clamping force of the pliers is greater than the force which is necessary for release of the catch 13.

The expanding spring 26 serves both as a restoring spring for the clamping pliers 1 and also for subjecting the catch 13 to loading in the engagement direction.

If the clamping pliers 1 are to be moved into a space-saving storage and/or packaging position, all that is required is for the handle sections 8, 9 to be moved toward one another. In this case, the catch 13 moves with ratchet action over the toothing formation 12 of the arcuate toothed strip 11. A self-securing closure position is then present, it being possible for said position to be released again in the manner described above by pressure on the actuating button 17.

The actuating section 17 or the catch 13 forming it is suitably made to stand out by being of a contrasting color.

The clamping or expanding pliers according to the second exemplary embodiment (FIG. 9 ff.) is basically of the same construction apart from a specific configuration of the functional parts formed by the catch/actuating section 13/17. The reference numerals are used analogously, in some cases without repetitions in the text.

Thus, in this case, catch 13 and the actuating section 17 are no longer in one piece, but are formed in two parts, these being associated in an articulated and displaceable manner.

The actuating section 17, which functions as a pivoting pushbutton, is fitted onto the pin which provides the rotatable mounting of the actuating section, designated below as bearing pin 19 in the pliers arm 5. It is also the case that a catch tail 35, which projects from the catch 13, is secured by the bearing pin 19. For this purpose, said catch tail 35 has a through-passage in the form of a longitudinal slot 36. The latter allows a limited displacement of the catch 13 relative to the pin. The longitudinal slot 36 extends directionally essentially tangentially, but spaced apart from the arcuate toothed strip 11 of the pliers arm 4.

A second means for securing the catch tail 35, said second means being closer to the catch 13, is provided in the form of an angled slot 37. This slot 37 is located between the longitudinal slot 36 and a neck 38 of the catch 13. The plate-like catch tail 35 has the necessary width for this purpose.

It can be seen that in regard to the angled slot 37, there is in question a heart-shaped through-passage. This is right-angled and has a first slot section 37'. The latter is roughly aligned with the scissors-articulation pin 2 and, in the clamping position of the clamping pliers 1, runs transversely to a connecting line x—x between tooth-engagement point 39 of the catch 13 and the bearing pin 19. Its catch-head-side flank F is similar to an undercut. It is located at just under 90° to the line x—x.

The second slot section 37" extends, in the said position, in a direction which runs substantially parallel to said connecting line x—x.

A disengagement pin 40 serves as securing means in the direction of the actuating section 17. With actuation of the blocking device, said disengagement pin changes over from the first slot section 37' of the angled slot 37 into the second slot section 37" of the same.

The second slot section 37" extends in the same direction as the longitudinal slot 36. The two are of the same length. The axial length of the disengagement pin 40 corresponds substantially to the thickness of the likewise plate-like actuating section 17. The actuating section 17 has in each case a bearing eyelet 41 for entry of the ends of the disengagement pin 40. In the receiving region of the catch tail 35, the actuating section 17 is provided with a receiving recess 42 which is dimensioned in accordance with the movement requirement of the catch tail 35, which is guided therein. The blockingly acting head of the catch 13 is located outside the boundary of the actuating section 17 and/or the guide pocket formed by the same, and can be perceived to be widened at the end.

As can be gathered from the drawings, it is not only the actuating section 17 here, but at the same time also the encased body of the catch tail 35, which is forced in the direction of a basic position by the arm 25 of the expanding spring 26.

The flattened ends of the disengagement pin 40 are guided on the insides of the window 20 of the pliers arm 5, through which the pliers arm 4 engages. The bearing eyelet for the bearing pin 19 is designated by 43. A bore 44 in the handle section 8 of the pliers arm 5, through which the pliers arm 4 engages, is located opposite this bearing eyelet 43 of the actuating section 17, in a congruently aligned manner.

Longitudinal slot 34 and angled slot 37 make it possible, upon the first actuation in the clamping position, for catch 13 and actuating section 17 to be pivoted toward one another and to be displaced. Pivoting takes place immediately. This actuation results in the spacing between the tooth-engagement point 39 of the catch 13 and toothing formation 12 and the bearing pin 19 being shortened by a first actuation of the actuating section 17 such that the two clamping sections 7, 9 are disengaged from the clamping position (see FIGS. 12 and 15) into a release position (see FIGS. 13 and 17). In this case, as can be gathered from FIG. 17, the tooth engagement between the toothing formation 12 of the arcuate toothed strip 11 and the mating toothing formation 14 of the catch 13 is maintained. The disengagement operation taking place in this manner shortens, via the free movement provided by the second slot section 37", the supporting length between tooth-engagement point 39 and said bearing pin 19. A limited opening movement takes place in the region of the knuckle joint G and raises the clamping jaws 28 away from a gripped object 45 (see FIG. 13). Accordingly, this is all achieved by the guide-slot-like control of the ratchet unit, that is to say via the disengagement pin 40, which is associated with the actuating section 17 and engages in the angled slot 37 of the catch 13. Said disengagement pin, in the position associated with the clamping position, is in blocking engagement in the first slot section 37', which runs substantially transversely to the connecting line x—x between tooth-engagement point 39 and bearing pin 19, supported by the flank F, and, in the position associated with the release position, is in the second slot section 37", which runs substantially parallel to the connecting line x—x. This proceeds via the intermediate position which is illustrated in FIG. 16, in which the flank support of the slot section 37' comes to an end. The disengagement pin 40 moves via the vertex zone into the other, that is to say second slot section 37", and/or the catch tail 35 overruns the same. This displacement takes place without pivoting in relation to the actuating section 17 as a result of the slot section 37" and longitudinal slot 36 running in the same direction. It is even possible for the longitudinal axes of the slots to be aligned coaxially. In this securing position, the now functionally single-part catch 13/17 can be used for further actuation, i.e. the second actuation of the actuating section 17 is initiated, the blockingly acting tooth engagement 12/14 being released. The tool can enter into the maximum expanded position according to FIG. 18, forming a large pliers mouth 10 for gripping the object 45.

As can be gathered from FIG. 17, the tooth engagement is restricted there to the upwardly-located end tooth and, if appropriate, partial engagement of the next-following tooth. It is easily possible for this position to be disengaged; this is because, with close-fitting blocking engagement of the teeth, multiple interengagement is provided as a result of the sawtooth-like structure. The blockingly active flanks of the teeth and tooth gaps thus always provide initially a short, relatively firm clamping action prior to the unblocking operation. It can be gathered from FIG. 17 that the lower end tooth of the mating. toothing formation 14 of the catch and most of the next-following teeth are already disengaged from the toothing formation 12.

All disclosed features of this application are pertinent to the invention. The disclosure content of the associated/attached priority documents (copy of the prior application) is hereby also included as to its full content in the disclosure of the application, also for the purpose of incorporating features of these documents in claims of the present application.

What is claimed is:

1. Clamping pliers comprising:

a first plier arm having a first handle portion and a first workpiece grip_structure distal from said first handle portion;

a second plier arm having a second handle portion and a second workpiece grip structure distal from said second handle portion, pivotally connected in a scissor arrangement to said first plier arm, such that said first plier arm is movable with respect to said second plier arm about a plier pivot axis;

a bias spring arranged to urge a separating movement of said first plier arm with respect to said second plier arm, about said plier pivot axis, such that said first workpiece grip structure moves away from said second workpiece grip support structure and said first handle portion moves away from said second handle portion;

a toothed structure attached to one of said first plier arm and said second plier arm;

a manually movable actuation member movably connected to the other of said first plier arm and said second plier arm;

a catch member, having a tooth engagement structure, movably connected to the other of said first plier arm and said second plier arm to be movable between a resting position and a release position by a movement of the manually movable actuator member, wherein said tooth engagement structure is engaged with said tooth structure in the resting position to substantially prevent said separating movement, wherein said manually movable actuator member, said catch member and said bias spring are arranged such that said bias spring urges said catch member toward said resting position, wherein said catch member and said manually movable actuator member are movably connected to said other of said first plier arm and said second plier arm by a first pivot pin extending through said catch member, and through said manually movable actuator member and said other of said first plier arm and said second plier arm, and wherein said catch member includes a first elongated slot and a second L-shaped slot having a first elongated section extending substantially parallel to an extending direction of said first elongated slot and a second elongated section extending substantially perpendicular to said first elongated section and wherein said catch member is movably connected to said other of said first plier arm and said second plier arm by said first pivot pin extending through said first elongated slot and by a second pivot pin extending parallel to said first pivot pin from said manually movable actuator member into said L-shaped slot.

2. Clamping pliers according to claim 1 wherein said manual actuator member, said first pivot pin, and said second pivot pin are arranged such that when said catch member is in said resting position said first pivot pin extends through a first end of said first elongated slot and said second pivot pin extends through a distal end of said second section of said L-shaped slot.

3. Clamping pliers according to claim 2 wherein said manual actuator member, said first pivot pin, and said second pivot pin are arranged such that a motion of said manual actuator moves said catch member from said resting position to an intermediate release position in which said first pivot pin extends through an end of said first elongated slot distal from said first end and wherein said second pivot pin extends through a distal end of said first elongated section of said L-shaped slot, and wherein said moving said catch member from said resting position to said intermediate release position allows a first amount of said separating movement of said first workpiece grip structure with respect to said second workpiece grip structure without disengaging said tooth engagement structure from said toothed structure.

4. Clamping pliers according to claim 1 wherein one of said first plier arm and said second plier arm includes a through channel having a first and a second wall facing each other, and a portion of the other of said first plier arm and said second plier arm extends through said channel, and wherein said first plier arm and said second plier arm are pivotally connected to each other by a pivot pin extending through said first wall, said portion and said second wall.

5. Clamping pliers comprising:

a first plier arm having a first handle portion and a first workpiece grip structure distal from said first handle portion;

a second plier arm having a second handle portion and a second workpiece grip structure distal from said second handle portion, pivotally connected in a scissor arrangement to said first plier arm, such that said first plier arm is movable with respect to said second plier arm about a plier pivot axis;

a bias spring arranged to urge a separating movement of said first plier arm with respect to said second plier arm, about said plier pivot axis, such that said first workpiece grip structure moves away from said second workpiece grip support structure and said first handle portion moves away from said second handle portion;

a toothed structure attached to one of said first plier arm and said second plier arm;

a manually movable actuation member movably connected to the other of said first plier arm and said second plier arm;

a catch member, having a tooth engagement structure, movably connected to the other of said first plier arm and said second plier arm to be movable between a resting position and a release position by a movement of the manually movable actuator member, wherein said tooth engagement structure is engaged with said tooth structure in the resting position to substantially prevent said separating movement, wherein said manually movable actuator member, said catch member and said bias spring are arranged such that said bias spring urges said catch member toward said resting position, and wherein said catch member is movably connected to said one of said first plier arm and said second plier arm to be movable between said resting position and an intermediate release position, and wherein a motion of said manually movable actuator moves said catch member from said resting position to said intermediate release position, and wherein said moving said catch member from said resting position to said intermediate release position allows a first amount of said separating movement of said first workpiece grip structure with respect to said second workpiece grip structure without disengaging said tooth engagement structure from said toothed structure.

6. Clamping pliers according to claim 5 wherein said manually movable actuator member, said first pivot pin, and said second pivot pin are arranged such that a human hand can exert a force on said manually movable actuator to move said catch member from said resting position to said intermediate release position without applying substantial compressive force urging said first handle portion toward said second handle portion.

7. Clamping pliers according to claim 5 wherein said toothed structure has a first arcuate toothed surface.

8. Clamping pliers according to claim 7 wherein a first plurality of teeth are disposed on said first arcuate toothed structure and said tooth engagement structure has a second arcuate toothed surface, and wherein a plurality of teeth on said second arcuate toothed surface engage with a subplurality of teeth from among said first plurality of teeth, said subplurality dependent on a spacing of said first workpiece grip structure with respect to said second workpiece grip structure when said catch member is in said resting position.

9. Clamping pliers according to claim 8 wherein said plurality of teeth on said second arcuate toothed surface remain engaged with the same subplurality of teeth on said first arcuate toothed surface while said catch member is moved from said resting position to said intermediate release position and said first workpiece grip structure moves said amount of separating movement with respect to said second workpiece grip structure.

10. Clamping pliers comprising:

a first plier arm having a first handle portion and a first workpiece grip structure distal from said first handle portion;

a second plier arm having a second handle portion and a second workpiece grip structure distal from said second handle portion, pivotally connected in a scissor arrangement to said first plier arm, such that said first plier arm is movable with respect to said second plier arm about a plier pivot axis;

a bias spring arranged to urge a separating movement of said first plier arm with respect to said second plier arm, about said plier pivot axis, such that said first workpiece grip structure moves away from second workpiece grip support structure and said first handle portion moves away from said second handle portion;

a toothed structure attached to one of said first plier arm and said second plier arm;

a manually movable actuation member movably connected to the other of said first plier arm and said second plier arm;

a catch member, having a tooth engagement structure, movably connected to the other of said first plier arm and said second plier arm to be movable between a resting position and an intermediate release position, wherein said manually movable actuator member and said catch member are arranged such that a motion of said manually movable actuator member moves said catch member from said first position to said intermediate release position, and wherein said moving said catch member from said first position to said intermediate release position allows a first amount of said separating movement without disengaging said tooth engagement structure from said toothed structure.

11. Clamping pliers according to claim 10 wherein a further motion of said manually movable actuator member moves said catch member from said intermediate release position to a full release position, and wherein said tooth engagement structure is disengaged from said toothed structure in said full release position, so as to allow a further amount of said separating movement of said first workpiece grip structure with respect to said second workpiece grip structure.

12. Clamping pliers according to claim 10 wherein one of said first plier arm and said second plier arm includes a through channel having a first and a second wall facing each other, and a portion of the other of said first plier arm and said second plier arm extends through said channel, and wherein said first plier arm and said second plier arm are pivotally connected to each other by a pivot pin extending through said first wall, said portion and said second wall.

13. Clamping pliers according to claim 10 wherein said manually movable actuator member, said first pivot pin, and said second pivot pin are arranged such that a human hand can exert a force on said manually movable actuator to move said catch member from said resting position to said intermediate release position without applying substantial compressive force urging said first handle portion toward said second handle portion.

14. Clamping pliers according to claim 10 wherein said toothed structure has a first arcuate toothed surface.

15. Clamping pliers according to claim 14 wherein a first plurality of teeth are disposed on said first arcuate toothed structure and said tooth engagement structure has a second arcuate toothed surface, and wherein a plurality of teeth on said second arcuate toothed surface engage with a subplurality of teeth from among said first plurality of teeth, said subplurality dependent on a spacing of said first workpiece grip structure with respect to said second workpiece grip structure when said catch member is in said resting position.

16. Clamping pliers according to claim 15 wherein said plurality of teeth on said second arcuate toothed surface remain engaged with the same subplurality of teeth on said first arcuate toothed surface while said catch member is moved from said resting position to said intermediate release position and said first workpiece grip structure moves said amount of separating movement with respect to said second workpiece grip structure.

17. Clamping pliers comprising:

a first plier arm having a first handle portion and a first workpiece grip structure distal from said first handle portion;

a second plier arm having a second handle portion and a second workpiece grip structure distal from said second handle portion, pivotally connected in a scissor arrangement to said first plier arm, such that said first plier arm is movable with respect to said second plier arm about a plier pivot axis, wherein said second plier arm is pivotally connected to said first plier arm by a pivot pin, colinear with said plier pivot axis, connected to one of said first plier arm and said second plier arm and extending into the other of said first plier arm and said second plier arm;

a bias spring arranged to urge a separating movement of said first plier arm with respect to said second plier arm, about said plier pivot axis, such that said first workpiece grip structure moves away from said second workpiece grip support structure and said first handle portion moves away from said second handle portion, said bias spring secured by said pivot pin;

a toothed structure attached to one of said first plier arm and said second plier arm;

a manually movable actuation member movably connected to the other of said first plier arm and said second plier arm;

a catch member, having a tooth engagement structure, movably connected to the other of said first plier arm and said second plier arm to be movable between a resting position and a release position by a movement of the manually movable actuator member, wherein said tooth engagement structure is engaged with said tooth structure in the resting position to substantially prevent said separating movement, wherein said manually movable actuator member, said catch member and said bias spring are arranged such that said bias spring urges said catch member toward said resting position, and wherein said toothed structure is attached to one of said first plier arm and said second plier arm by said pivot pin.

18. Clamping pliers according to claim 17 wherein one of said first and second plier arms includes an arcuate recess and wherein said toothed structure has an arcuate toothed surface arranged within said arcuate recess.

* * * * *